US005651267A

United States Patent [19]

Todescat et al.

[11] Patent Number: 5,651,267

[45] Date of Patent: Jul. 29, 1997

[54] STARTING ARRANGEMENT FOR SMALL REFRIGERATION SYSTEMS

[75] Inventors: Marcio Luiz Todescat; Dietmar Erich Bernhard Lilie; Manfred Krueger, all of Joinville - SC, Brazil

[73] Assignee: Empresa Brasileira de Compressores S/A - Embraco, Joinville - SC, Brazil

[21] Appl. No.: 432,201

[22] PCT Filed: Feb. 1, 1994

[86] PCT No.: PCT/BR94/00004

§ 371 Date: May 5, 1995

§ 102(e) Date: May 5, 1995

[87] PCT Pub. No.: WO94/18512

PCT Pub. Date: Aug. 18, 1994

[30] Foreign Application Priority Data

Feb. 9, 1993 [BR] Brazil ..... 9300342

[51] Int. Cl.[6] ..... F04B 49/00; F25B 1/00

[52] U.S. Cl. ..... 62/498; 417/297

[58] Field of Search ..... 62/498, 115; 418/14; 417/297

[56] References Cited

U.S. PATENT DOCUMENTS

| | | | |
|---|---|---|---|
| 2,074,911 | 3/1937 | Hull . | |
| 2,080,288 | 5/1937 | McCormack . | |
| 2,314,591 | 3/1943 | McCormack . | |
| 2,579,429 | 12/1951 | Noe . | |
| 3,545,220 | 12/1970 | Teegarden | 62/196.1 |
| 3,606,588 | 9/1971 | Romerhaus | 417/292 |
| 4,026,122 | 5/1977 | Kuhn et al. | 62/196.3 |

FOREIGN PATENT DOCUMENTS

| | | | |
|---|---|---|---|
| 0042117 | 12/1981 | European Pat. Off. | 62/196.3 |
| 0153557 | 9/1985 | European Pat. Off. | 62/498 |
| 520877 | 5/1940 | United Kingdom . | |
| 2122325 | 1/1984 | United Kingdom . | |

*Primary Examiner*—William E. Wayner
*Attorney, Agent, or Firm*—Darby & Darby

[57] ABSTRACT

A refrigeration system having a compressor with a check valve on the high pressure side to prevent refrigerant migration when the compressor shuts down; the improvement comprising a slot at the discharge valve plate forming an equalizing volume to provide gas leakage to the low pressure side during a stoppage so as to reduce starting torque.

6 Claims, 2 Drawing Sheets

STARTING ARRANGEMENT FOR SMALL REFRIGERATION SYSTEMS

FIELD OF THE INVENTION

The present invention relates to a gas return blocking arrangement for small refrigeration equipments of the type presenting a hermetic compressor mounted in a gas pumping circuit, said arrangement further including a condenser, a capillary tube and an evaporator and being particularly useful in systems in which the pumping of the gas, after a long stop of the compressor, occurs in a condition of pressure gradient. Situations of this type are common in systems presenting reciprocating hermetic compressors.

BACKGROUND OF THE INVENTION

In these systems, when the temperature of the evaporator reaches a predetermined value and the compressor stops, there occurs the migration of the heated fluid, that is present at a high pressure portion of the system, where the condenser is located, towards a low pressure portion of said system, where the evaporator is located. This migration of refrigerant fluid to the evaporator at each stop of the compressor causes loss of refrigerating capacity in the system.

In a known solution, which is useful in refrigeration systems presenting reciprocating hermetic compressors, the gas pumping system receives between the condenser and the capillary tube a blocking valve, which avoids the hot gas from the condenser to reach the evaporator during the long stops of the compressor.

For compressors having a discharge valve designed for a completely sealing operation, the fluid under high pressure remains restricted and retained in the tube portion of the circuit situated downstream said discharge valve.

However, with this sealing, the compressor has to overcome a starting pressure, which is at least equal to the external high pressure existing downstream the discharge valve. As the piston compression stroke is completed with the motor still in the starting condition, the discharge valve will open a respective discharge chamber, before the normal operative condition is reached by the compressor, because the pressure in the cylinder will surpass that pressure existing downstream said discharge valve, at a time inferior to the starting time of the compressor.

In the case of compressors presenting a discharge valve with an impeller, the complete restriction to the passage of gas under high pressure into the inside of the discharge chamber will only exist if, at the stop of the compressor, the piston is at a maximum suction position. In this condition, the new start of said compressor will occur as described above.

In order to compensate the energetic loss in these cases, the new start of the compressor requires the use of a motor presenting a high starting torque. Such increase in the starting torque can also be obtained by incorporating to the system a starting capacitor. Nevertheless, such solutions increase the cost of the product.

The compressors having a discharge valve with an impeller further present another problem, resulting from the stop of the compressor when the piston is at a portion different from that of maximum suction. In this situation, the discharge valve does not seal the discharge chamber completely, thereby allowing leakages of high pressure gas downstream said compressor towards the inside of the latter and, consequently, towards the evaporator, thus causing a loss in the refrigerating capacity of the system.

DISCLOSURE OF THE INVENTION

Thus, it is an object of the present invention to provide a starting arrangement for small refrigeration systems, particularly those using reciprocating hermetic compressors, the arrangement being capable of blocking, during the long stops of the compressor, the passage of heated gas from the compressor to the evaporator and allowing the motor of the compressor to reach an operative condition before the opening pressure of the discharge valve reaches a value corresponding to the high operative pressure of the refrigeration system.

These and other objectives of the present invention are achieved through a starting arrangement for small refrigeration systems, said system presenting: a high pressure region, including a condenser and defined between the discharge valve of the cylinder of a reciprocating hermetic compressor and a blocking valve; a low pressure region, defined between the suction valve of the cylinder of said hermetic compressor and said blocking valve and including an evaporator; a check valve, disposed at a portion of the high pressure region, so as to define with the discharge valve of the compressor a gas pressure equalizing volume, dimensioned so as to make its pressure increase from the low pressure up to the high pressure of the system at a time at least equal to the time required by the compressor to reach its normal operative condition, after a stop period in the system operation, said pressure equalizing volume being in permanent fluid communication with the low pressure portion of said refrigeration system, said fluid communication being dimensioned in such a way as to provide said region with an equalizing pressure that is substantially close to the low pressure existing at the other region of the circuit, at each of the stop periods of the system.

BRIEF DESCRIPTION OF THE DRAWINGS

The invention will be described below, with reference to the attached drawings, in which.

Said arrangement can be mounted to conventional refrigeration systems using reciprocating hermetic compressors, without requiring constructive alterations in said systems.

BEST MODE FOR CARRYING OUT THE INVENTION

Figure 1:
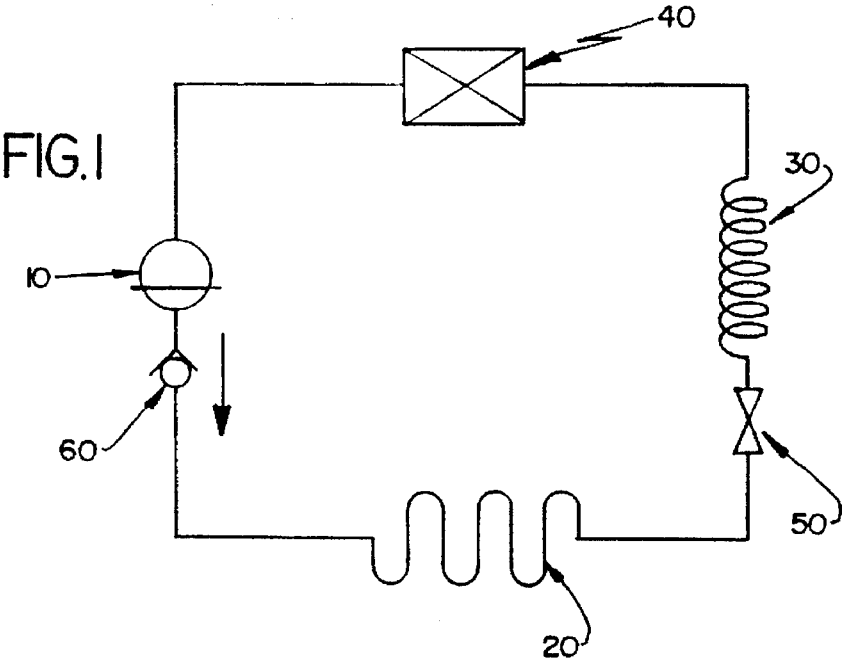
FIG. 1 is a schematic illustration of a refrigeration system according to the invention.

As illustrated in FIG. 1, the refrigeration system mainly comprises an hermetic compressor 10, particularly a reciprocating hermetic compressor, a condenser 20, a capillary tube 30, an evaporator 40, a blocking valve 50 and a one-way check valve 60.

In this refrigeration system, the blocking valve 50 is disposed between the condenser 20 and the capillary tube 30, so as to selectively interrupt the flow of refrigerant gas that is flowing through the system when the compressor stops. This interruption occurs because said blocking valve 50 closes at said stop condition of the compressor and prevents the refrigerant gas, during said time interval, from reaching the evaporator 40, thereby allowing the whole refrigeration system to achieve a pressure balance.

The start of the motor determines the opening of said blocking valve 50, thus restarting the above mentioned fluid communication through the inside of the refrigeration system.

In order to avoid said fluid under high pressure to reach the evaporator 40, by passing inside the compressor 10 at the compressor stop, the one-way check valve 60 is installed, according to the present invention, between the compressor 10 and the condenser 20 at a certain distance from said compressor, creating a volume at the discharge circuit of the compressor, said volume being defined between the discharge valve and the check valve 60 thereof.

Said disposition of the check valve 60 mentioned above makes the high pressure gas be restricted to a region of the present system between the compressor 10 and the blocking valve 50.

Figure 2:
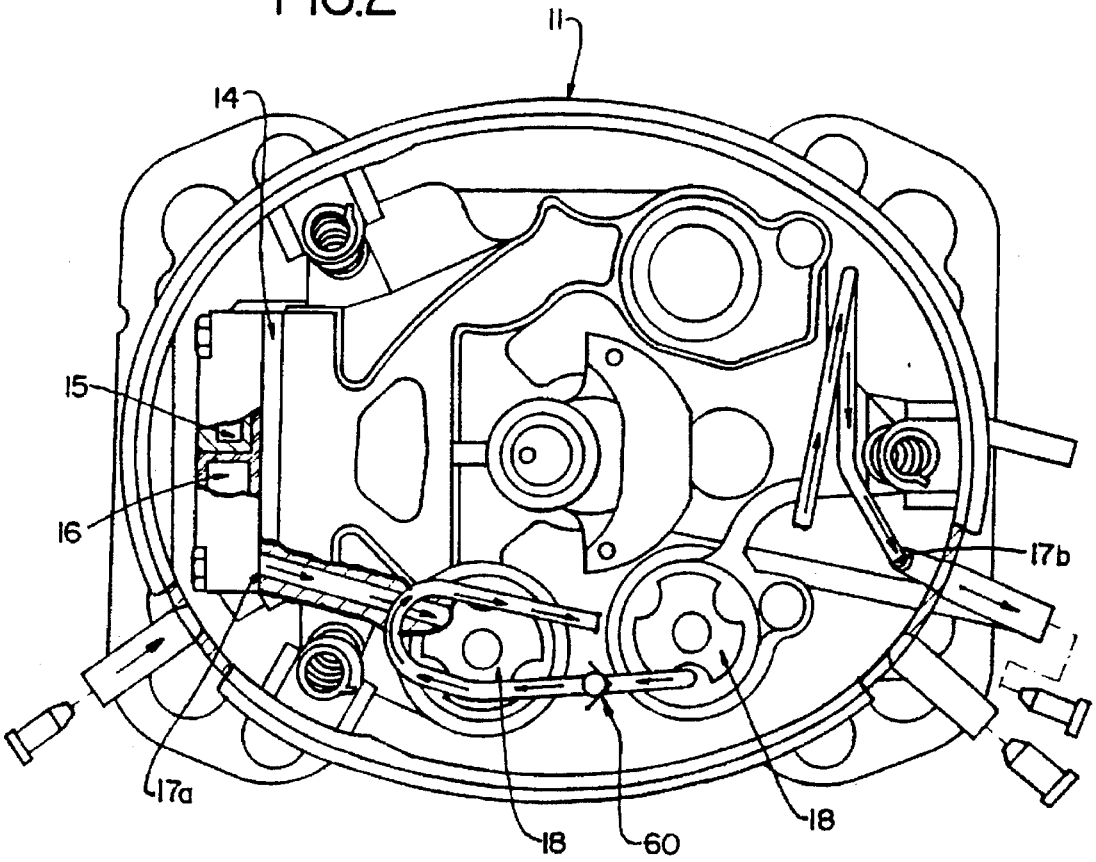
FIG. 2 is an upper view of a reciprocating hermetic compressor, which is without the upper cover of its case and which is useful in the system of the present invention.
Figure 3:
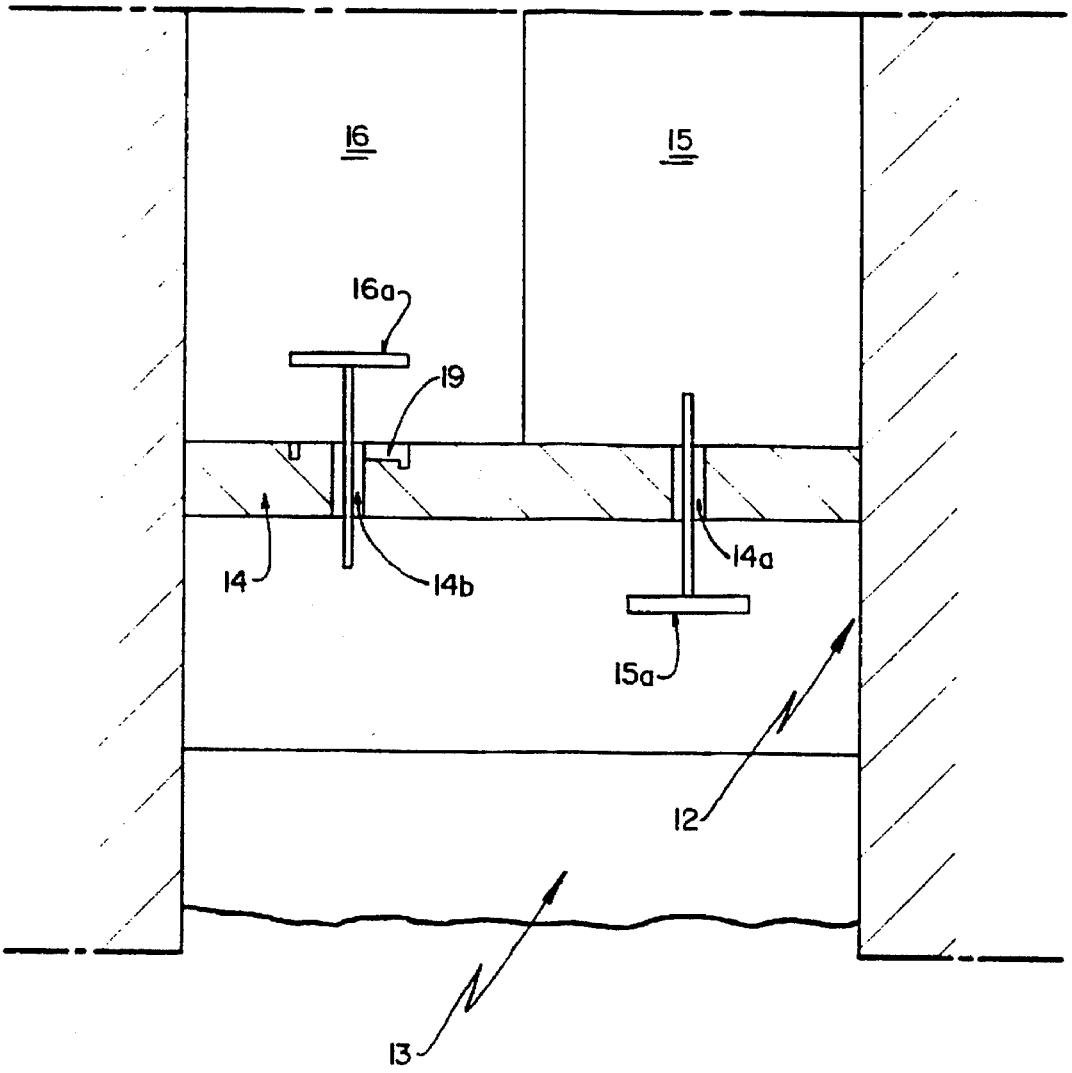
FIG. 3 is longitudinal section view of a portion of the cylinder and of the valve plate of the compressor, according to FIG. 2 and illustrating an embodiment of the present invention.

According to the illustrated FIGS. 2 and 3, the compressor 10 comprises a hermetic case 11, in which there is suspended, through springs, a motor-compressor assembly, including a cylinder block, in which the cylinder 12 lodges a reciprocating piston 13, that moves inside said cylinder 12, aspirating and compressing the refrigerant gas when actuated by the electric motor. Said cylinder 12 presents an open end, which is covered by a valve plate 14, which is attached to said cylinder block and which is provided with suction orifices 14*a* and discharge orifices 14*b*. Said cylinder block further supports a cylinder head, which is attached onto said valve plate 14 and which defines, internally with the latter, suction and discharge chambers 15, 16, respectively, which are maintained in selective fluid communication with the cylinder 12, through the respective suction and discharge orifices, 14*a*, 14*b*. This selective communication is defined by the opening and closing of said suction and discharge orifices 14*a*, 14*b* through respective suction and discharge valves 15*a*, 16*a*.

The hermetic case 11 further supports a discharge tube 17, presenting an end 17*a* opened to the discharge chamber 16 and an opposite end 17*b*, opened to an orifice provided at the surface of the hermetic case 11, communicating said discharge chamber 16 with a high pressure side of the present refrigeration system.

Said discharge tube 17 further incorporates first and second discharge mufflers 18, in the form of expanding volumes, which act as sound absorbers for the compressor and in which the high pressure fluid, coming from the discharge chamber 16 is expanded before reaching the exterior of the compressor 10.

During the operative period of the compressor, the gas, after being compressed in the cylinder 12, leaves the latter through the discharge orifice 14*b*, and reaches the inside of the discharge chamber 16, where a high temperature is maintained due to the compression to which the refrigerant fluid is subjected inside the cylinder.

According to the present invention, the check valve 60 is disposed at the present refrigeration system adjacent to the second end 17*b* of the discharge tube 17 and, at the illustrated example, internally to the hermetic case 11, thereby forming between said check valve 60 and the discharge orifice 14*b* of the discharge chamber 16, during the compressor stop, an equalizing volume of variable pressure, as described below, in constant fluid communication with the low pressure portion of the refrigerating circuit that is disposed upstream the discharge valve 16*a* and downstream the capillary tube 30.

The gas leakage to the inside of said low pressure portion through said fluid communication is calculated to represent a minimum fraction of the gas volume pumped by the compressor under operation, so as not to cause any relevant loss in the volumetric efficiency of the compressor. Nevertheless, the dimensioning of said fluid communication should be such as to permit, during a period of normal stop of the compressor under operation in the refrigeration system, the pressure of said equalizing volume to drop to a value substantially equal to the pressure at the low pressure portion in the refrigerating circuit, or to drop to a value which corresponds to a starting current of the motor, at the maximum 10% higher than the nominal operative current of the motor.

After the compressor stops, when the pressures upstream and downstream the check valve 60 are equal, a fraction of said gas volume begins to leak slowly to the inside of the low pressure portion of the refrigeration system, till it reaches a substantial equalization with the pressure of said refrigerating portion.

Such pressure equalization permits the compressor to start each new operation, working with a minimum load and therefore requiring a low torque of the motor at each new start.

In a preferred illustrate constructive form of the present invention, the gas leakage to the inside of the low pressure portion occurs through at least one gas discharge opening 19, in the form of a leakage slot made at a face of the valve plate 14, where is defined the seat of the discharge valve 16*a*, communicating the inside of the discharge chamber 16 with the cylinder 12 and, consequently, with the inside of the case 11, which is constantly under low pressure in these compressors.

In a possible alternative form, at least one of said slots 19 is provided at the operative face of the sealing element of the discharge valve 16*a*. In this case, the discharge valve should be a valve whose thickness is sufficient to incorporate the slot, without impairing its operative characteristics.

The amount of leakage slots 19, as well as their forms and dimensions are defined by the high pressure gas leakage to the low pressure portion of the system required in order to obtain the pressure equalization upstream the check valve 60, during the stop period of the compressor.

In another possible embodiment, said gas leakage is obtained by the provision of at least one through hole at a portion of the discharge tube 17 between its lower end 17*a* and upper end 17*b*. In this construction, said refrigerant gas leaks directly from the discharge tube 17 to the inside of the case 11.

The intentional leakage of refrigerant gas to the low pressure portion of the system, mainly to the inside of the case 11, during the stop periods of the compressor, may also be used in compressors presenting discharge valves provided with an impeller, without altering the final result, since besides being minimal, said gas leakage to the case 11 is a function of the constructive physical characteristics of the gas discharge openings 19.

During the compression of said refrigerant gas, the losses of compressed gas, if they exist, will not be sufficient to impair the performance of the compressor.

We claim:

1. Starting arrangement for a refrigeration system having a high pressure region including a condenser connected between the discharge valve of the cylinder of a compressor having a hermetically sealed case and a blocking valve, and a low pressure region between the suction valve of the cylinder of said compressor and said blocking valve and including an evaporator comprising:

a check valve disposed at a portion of the high pressure region to define with the compressor discharge valve a gas pressure equalizing volume dimensioned to make its pressure rise from the low pressure up to the high pressure of the system at a time at least equal to the time required by the compressor to reach its normal operative condition after a stop period during system operation, a permanent fluid communication means disposed as part of the compressor and between said pressure equalizing volume and the low pressure region of said refrigeration system, said fluid communication means being dimensioned to provide said low pressure region with an equalizing pressure that is substantially close to the low pressure existing at the other region of the system at each stop period of the system.

2. Starting arrangement, according to claim 1, wherein said compressor includes an electric motor for actuating the compressor that requires at a normal starting condition of the compressor a starting current not higher than 10% of the nominal operating current.

3. Starting arrangement as in claim 1, wherein said fluid communication means comprises a slot in part of said discharge valve in communication with said low pressure region.

4. Starting arrangement for a refrigeration system having a high pressure region including a condenser connected between the discharge valve of the cylinder of a compressor having a hermetically sealed case and a blocking valve, and a low pressure region between the suction valve of the cylinder of said compressor and said blocking valve and including an evaporator, comprising:

a check valve disposed at a portion of the high pressure region to define with the compressor discharge valve a gas pressure equalizing volume dimensioned to make its pressure rise from the low pressure up to the high pressure of the system at a time at least equal to the time required by the compressor to reach its normal operative condition after a stop period during system operation, a permanent fluid communication means between said pressure equalizing volume and the low pressure region of said refrigeration system, said fluid communication means being dimensioned to provide said low pressure region with an equalizing pressure that is substantially close to the low pressure existing at the other region of the system at each stop period of the system wherein said fluid communication is provided through the compressor discharge valve.

5. Starting arrangement according to claim 4, wherein said fluid communication means comprises at least one slot in at least one of the parts defined by the valve seat and by the sealing element of the discharge valve.

6. Starting arrangement, according to claim 5, wherein said check valve is disposed internally of the compressor case.

* * * * *